United States Patent [19]

Shaw et al.

[11] Patent Number: 4,753,300

[45] Date of Patent: Jun. 28, 1988

[54] HYDRAULIC TOP DRIVE FOR WELLS

[75] Inventors: Daniel G. Shaw, Conroe; Billy Mac Cline, Houston, both of Tex.

[73] Assignee: Triten Corporation, Houston, Tex.

[21] Appl. No.: 16,980

[22] Filed: Feb. 26, 1987

Related U.S. Application Data

[63] Continuation of Ser. No. 657,302, Oct. 3, 1984, abandoned.

[51] Int. Cl.[4] ..... E21B 3/00

[52] U.S. Cl. ..... 173/164; 175/85; 166/77.5

[58] Field of Search ..... 175/85, 52; 173/164, 173/57, 79; 166/77.5

[56] References Cited

U.S. PATENT DOCUMENTS

| | | | |
|---|---|---|---|
| Re. 21,677 | 12/1940 | Tremolada | 173/57 |
| 1,377,575 | 5/1921 | Greve . | |
| 1,395,706 | 11/1921 | Greve . | |
| 1,398,551 | 11/1921 | Hanson . | |
| 1,949,908 | 3/1934 | Hawk . | |
| 2,016,785 | 10/1935 | Lawlor . | |
| 2,488,107 | 11/1949 | Abegg . | |
| 2,772,074 | 11/1956 | Stoffa | 173/57 |
| 2,860,487 | 11/1958 | Wheeler . | |
| 2,863,638 | 12/1958 | Thornburg . | |
| 3,021,739 | 2/1962 | Grundmann . | |
| 3,053,330 | 9/1962 | Arthur | 175/195 |
| 3,054,465 | 9/1962 | Fish | 175/185 |
| 3,191,450 | 6/1965 | Wilson | 74/219 |
| 3,209,543 | 10/1965 | Glover | 63/97 |
| 3,266,582 | 8/1966 | Homanick | 175/57 |
| 3,312,294 | 4/1967 | Wilson | 173/164 |
| 3,380,324 | 4/1968 | Hillman | 173/164 |
| 3,404,741 | 10/1968 | Gheorghe et al. | 175/85 |
| 3,426,855 | 2/1969 | Crooke et al. | 173/57 |
| 3,464,507 | 9/1969 | Alexander et al. | 175/85 |
| 3,467,202 | 9/1969 | Brown | 173/57 |
| 3,598,189 | 8/1971 | Presley et al. | 175/53 |
| 3,623,558 | 11/1971 | Brown | 173/57 |
| 3,747,675 | 7/1973 | Brown | 166/237 |
| 3,766,991 | 10/1973 | Brown | 173/20 |
| 3,768,579 | 10/1973 | Klein | 173/164 |

(List continued on next page.)

FOREIGN PATENT DOCUMENTS

| | | |
|---|---|---|
| 0165479 | 2/1983 | European Pat. Off. . |
| 0148588 | 12/1984 | European Pat. Off. . |
| 1127949 | 9/1968 | United Kingdom . |
| 1246290 | 9/1971 | United Kingdom . |
| 1332434 | 10/1973 | United Kingdom . |
| 1341007 | 12/1973 | United Kingdom . |
| 1452442 | 10/1976 | United Kingdom . |
| 2033948B | 5/1980 | United Kingdom . |
| 2124680 | 8/1982 | United Kingdom . |
| 2106952A | 4/1983 | United Kingdom . |

OTHER PUBLICATIONS

"ES-7 Electric Drilling Swiven System" Bowen Tools, Inc., Jul. 1979.

"Varco Power Sub Drilling System-Technical Bulletin No. B00101, Revision A", Varco Oil Tools, Jul. 1981.

"Trends in Rig Floor Technology", George Boyadjieff, Aug. 3, 1981.

"Drilling With Top Head Drives", Damon T. Slator, Prior to Oct. 3, 1983.

*Primary Examiner*—E. R. Kazenske
*Assistant Examiner*—James L. Wolfe
*Attorney, Agent, or Firm*—Vaden, Eickenroht, Thompson & Boulware

[57] ABSTRACT

An hydraulic top drive apparatus and tubular handling device mounted beneath a conventional crown block, traveling block, bail, and swivel, and including an hydraulically powered top drive pipe rotating device having a single hollow shaft with threads at each end for mating on one end with the drill string or tubular to be worked and on the other with a drilling swivel. The top drive rotating device is attached to a wheeled support frame which moves on guide rails which are mounted to a derrick. The top drive apparatus can be pivoted in a horizontal plane away from the vertical axis of the drill string or other tubulars. Motive force is applied directly to the drill string or other tubular being worked. A pivotable pipe lifting and positioning device is mounted beneath the top drive on the wheeled support frame for picking up pipe and positioning it so that the pipe threads can mate precisely with the threads of the top drive shaft. A makeup/breakout wrenching device is pivotably connected to the wheeled support frame beneath the top drive.

3 Claims, 4 Drawing Sheets

U.S. PATENT DOCUMENTS

| | | | |
|---|---|---|---|
| 3,776,320 | 12/1973 | Brown | 173/163 |
| 3,888,318 | 6/1975 | Brown | 173/149 |
| 3,994,350 | 11/1976 | Smith et al. | 175/85 |
| 4,037,672 | 7/1977 | Hodge | 173/157 |
| 4,074,775 | 2/1978 | Lee | 173/79 |
| 4,147,215 | 4/1979 | Hodge et al. | 166/315 |
| 4,226,447 | 10/1980 | Brown | 285/316 |
| 4,271,916 | 6/1981 | Williams | 175/215 |
| 4,293,047 | 10/1981 | Young | 175/195 |
| 4,296,820 | 10/1981 | Loftis | 175/85 |
| 4,314,611 | 12/1982 | Willis | 173/57 |
| 4,449,596 | 5/1984 | Boyadjieff | 175/85 |
| 4,458,768 | 7/1984 | Boyadjieff | 175/85 |
| 4,529,045 | 7/1985 | Boyadjieff et al. | 173/164 |
| 4,535,852 | 8/1985 | Boyadjieff et al. | 175/170 |

Fig. 5
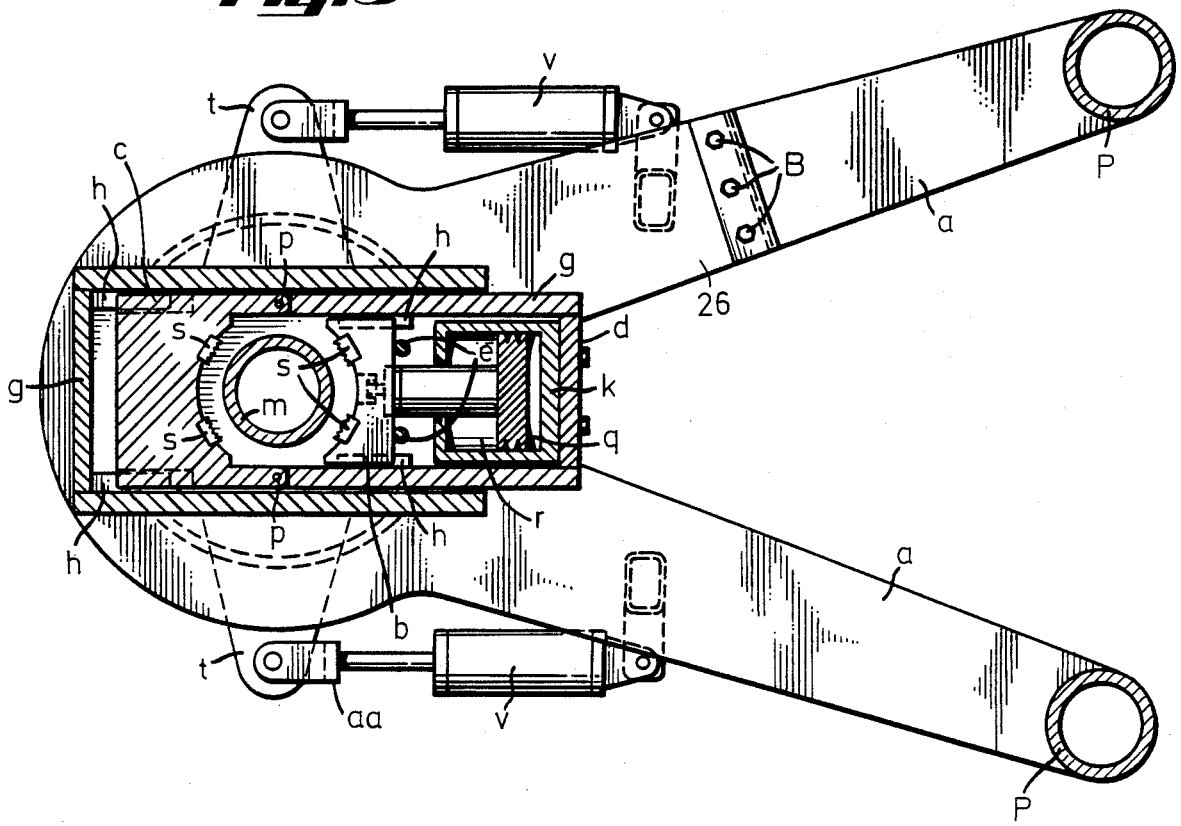
Fig. 6
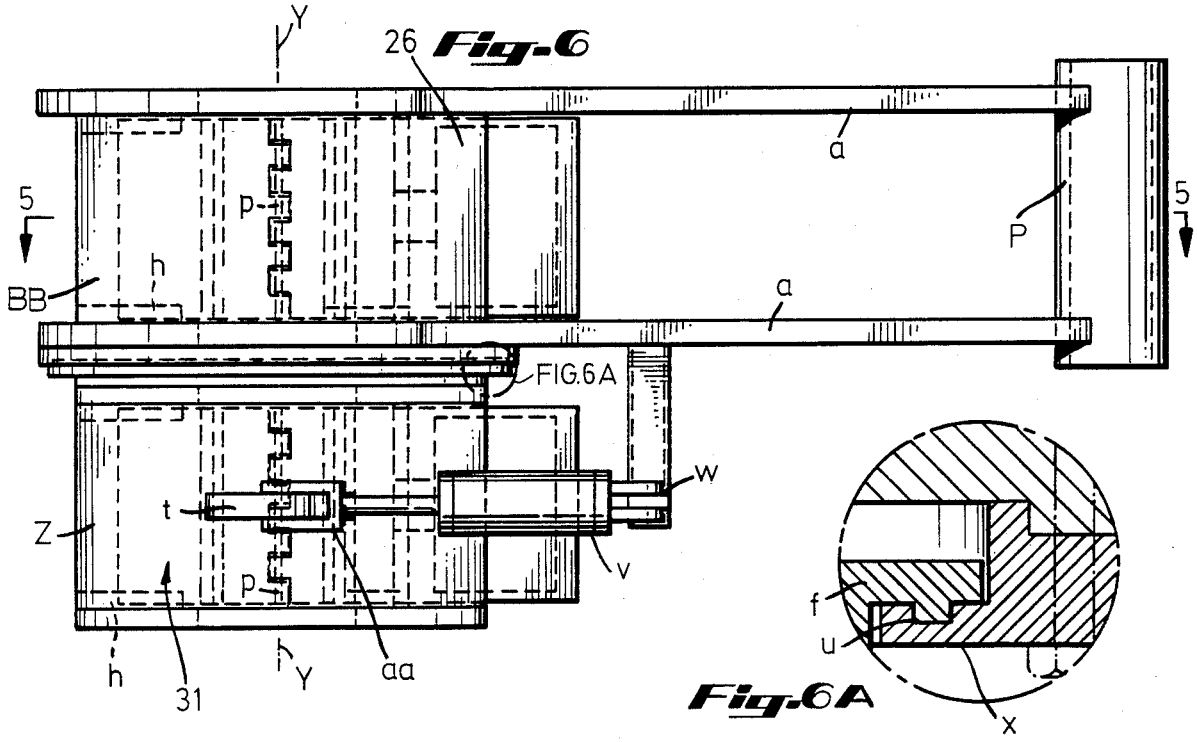
Fig. 6A

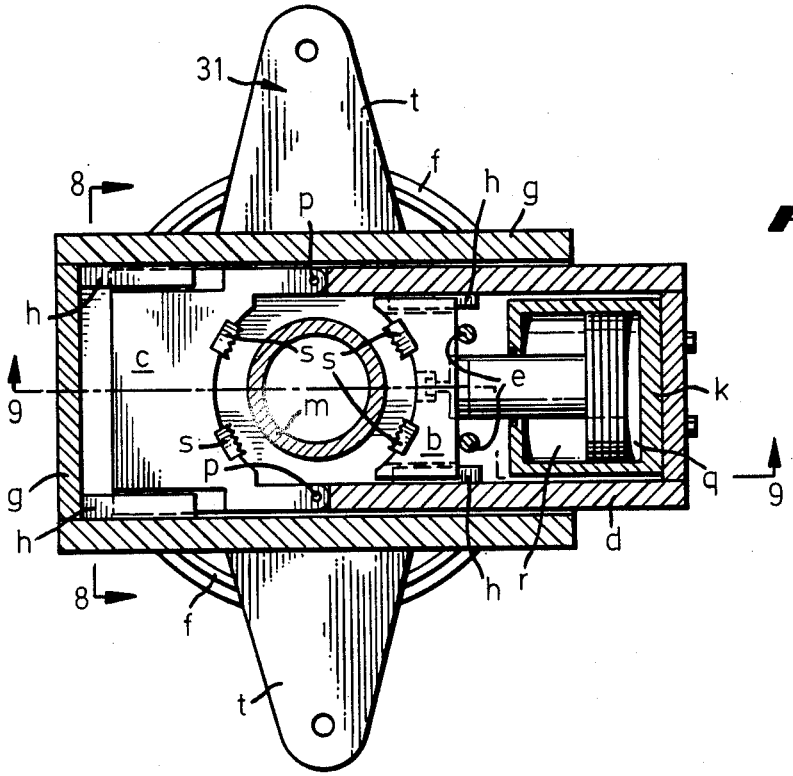
Fig. 7
Fig. 8
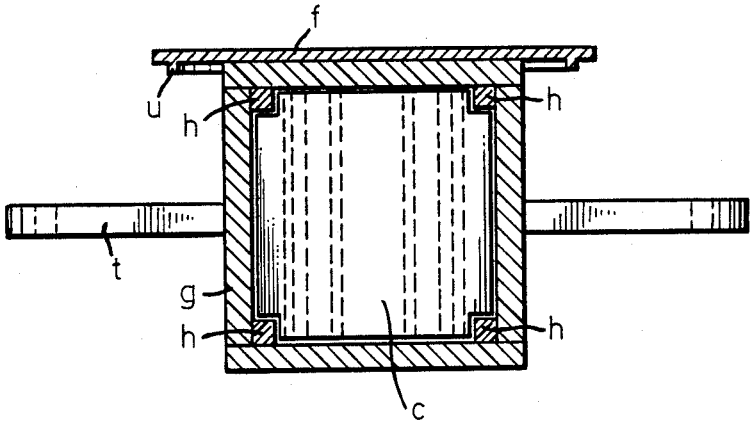
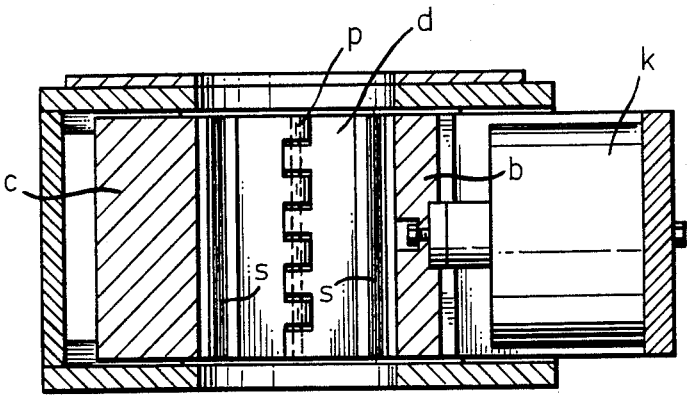
Fig. 9

HYDRAULIC TOP DRIVE FOR WELLS

This application is a continuation of application Ser. No. 657,302, filed Oct. 3, 1984, now abandoned.

BACKGROUND OF THE INVENTION

1. Field of the Invention

This invention relates to top drive well drilling and operation apparatus and tubular handling apparatus related thereto.

2. Description of the Prior Art

It has previously been common in well drilling and other well operations to impart motive force to the drill string or other tubular members being worked with by means of the old rotary table drive apparatus or electric motor top drives. The old rotary drive tables are inefficient and costly. The electric top drives have had numerous problems; for example, to move and support drill strings weighing up to 500 tons, the Direct Current traction motors used in electric top drives must be very large, consequently they require a large and effective motor cooling system. Also all of the safety problems associated with electricity are considerations when using an electric top drive. Because of these shortcomings, obtaining compliance with accepted safety codes and insurance certification for the use of electric top drives has been a tedious, expensive, and time-consuming process. There are also numerous structural/functional disadvantages associated with the use of electric top drives; for example, one prior art electric top drive utilizes an expensive thrust bearing to support the drill string rather than using the shaft of the motor itself. Another prior art electric top drive has an electric motor which is offset from the shaft supporting the drill string which results in an imbalance in the distribution of the reactive torque applied.

SUMMARY OF THE INVENTION

The present invention is directed to an hydraulic top drive apparatus and tubular handling device that overcomes the problems associated with the prior art drives. Mounted beneath a conventional crown block, traveling block, bail, and swivel, the present invention includes an hydraulically powered top drive pipe rotating device having a single hollow shaft with threads at each end for mating on one end with the drill string or tubular to be worked and on the other with a drilling swivel. The top drive rotating device is attached to a wheeled support frame which moves on guide rails which are mounted to a derrick. The mounting of the top drive apparatus permits it to be pivoted in a horizontal plane away from the vertical axis of the drill string or other tubulars. Motive force is applied directly to the drill string or other tubular being worked. Also, the top drive is fully reversible so that motive force can be applied in either direction. A makeup/breakout wrenching device is pivotably connected to the wheeled support frame beneath the top drive. A pipe lifting and positioning device is mounted beneath the top drive on the wheeled support frame for picking up pipe and positioning it so that the pipe threads can mate precisely with the threads of the top drive shaft.

It is, therefore, an object of the present invention to provide an efficient and safe hydraulic top drive for use in well operations.

Another object of the present invention is the provision of such a top drive which imparts a concentric and balanced motive force to the tubular to be worked.

Yet another object of the present invention is the provision of means for pivoting the top drive apparatus in a horizontal plane away from the drill string or other tubulars being worked without having to tilt the top drive from the vertical.

A further object of the present invention is the provision of such a top drive apparatus in which its shaft itself supports the drill string so that no thrust bearing support is required.

Another object of the present invention is the provision of such a top drive apparatus in combination with a pipe lifting and positioning device, both of which are mounted on a wheeled support which in turn is mounted on rails connected to the derrick for moving the top drive apparatus and pipe positioning device up and down within the derrick.

Yet another object of the present invention is the provision of such a top drive in which the pipe positioning device can be pivoted in a horizontal plane away from the drill string or other tubular being worked without having to tilt it from the vertical.

A further object of the present invention is the provision of such an hydraulic top drive apparatus in which full rated torque output can be achieved within safe operating limits.

Another object of the present invention is the provision of a device for precisely positioning drill pipe.

Yet another object of the present invention is the provision of an hydraulic top drive apparatus which permits the lifting of the drill bit off the bottom of the hole when making connections of pieces of the drill string.

Still another object is the provisions of such a top drive with which drill pipe connections may be broken at any elevation in the derrick and which provides smooth rotary torque at any elevation.

Another object of the present invention is the provision of such a top drive which can be utilized for all normal drilling, reaming and casing operations, can be used to drill with single or multiple sections of pipe, and can ream in ninety-foot increments.

Yet another object of the present invention is the provision of an hydraulic top drive apparatus which can be used to connect tubular members without using spinning chains.

A further object of the present invention is the provision of such a top drive that has a rise and fall counterbalance system.

Other and further objects, features and advantages of this new top drive apparatus and pipe positioning device will be apparent from the following description of the presently preferred embodiments of the invention, given for the purpose of disclosure and taken in conjunction with the accompanying drawings.

BRIEF DESCRIPTION OF THE DRAWINGS

FIG. 5 is a top view partially in section of a pivotable breakout/makeup wrenching device assembly, FIG. 6 is a side view of the assembly of FIG. 5, FIG. 6A is an enlarged view of a portion of FIG. 6, FIG. 7 is a bottom view partially in section of the lower section of the assembly of FIG. 6, FIG. 8 is a sectional view of the assembly of FIG. 7, and FIG. 9 is a sectional view of the power clamping apparatus of the assembly of FIG. 6.

DESCRIPTION OF THE PREFERRED EMBODIMENT

Figure 1:
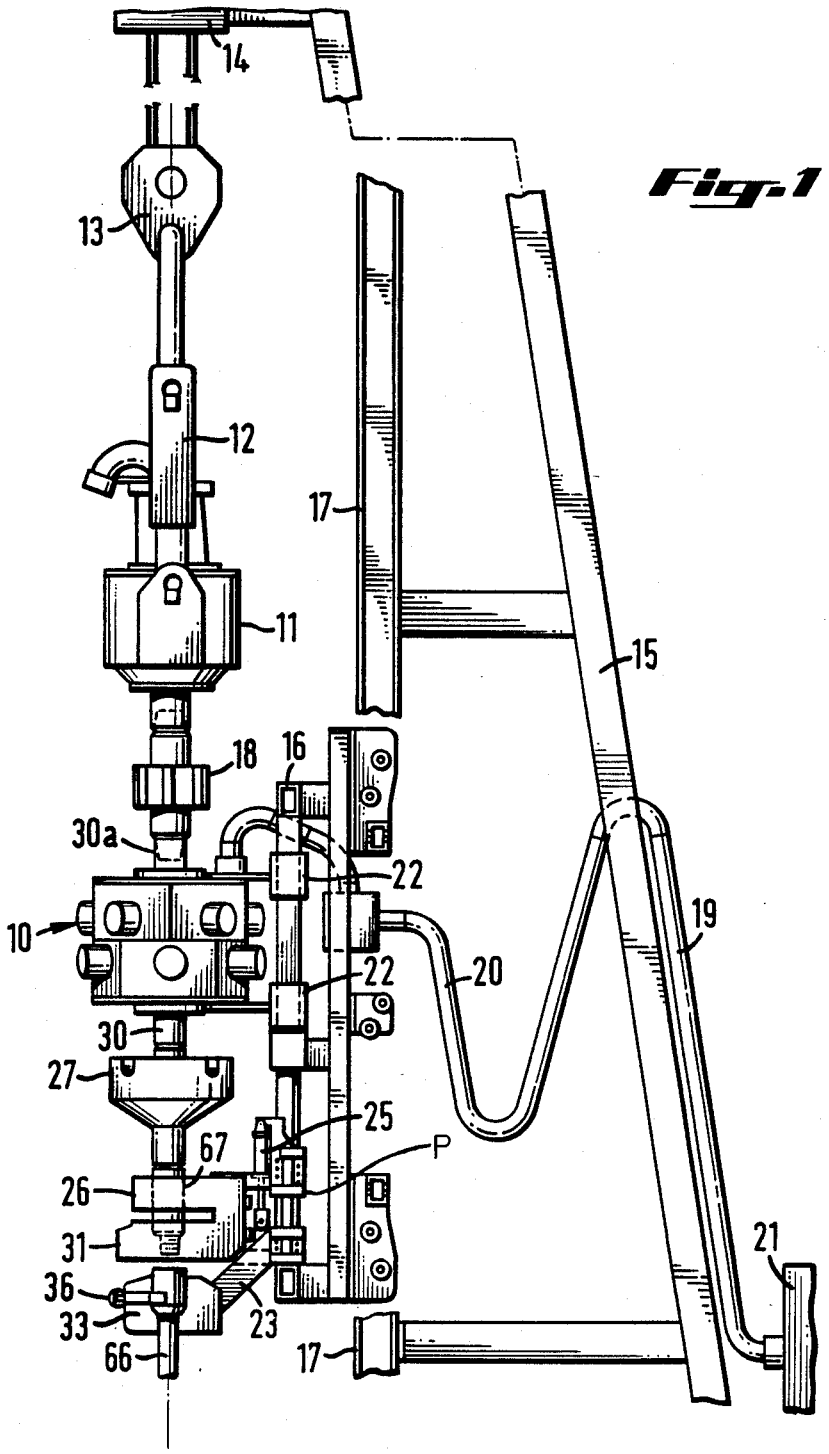
FIG. 1 is an elevational view of a derrick showing an hydraulic top drive according to the present invention.

Referring now to FIG. 1, an hydraulically powered drilling top drive apparatus 10 according to the present invention is suspended from a commercially available swivel 11 fitted with optional bail links 12 for counterbalancing. This swivel in turn is attached to a traveling block 13 which is attached by cables to a crown block 14 in the derrick 15. The top drive 10 is attached to a wheeled support frame 16 which is mounted upon guide rails 17 which are mounted to the derrick 15. The attachment of the drilling top drive 10 to the swivel 11 shaft may be made through a one piece threaded hollow shaft or by using a splined quick disconnect 18. The hydraulic fluid which operates the top drive 10 is conducted through pipes 19 and hoses 20 from a power unit 21 located at a convenient point. The top drive 10 has a hollow shaft with a threaded top end 30*a* for connection to the swivel 11.

The drilling top drive 10 is attached to the wheeled support frame 16 in such a manner that it may be rotated in a horizontal plane about pivots 22 on the wheeled support frames 16 for maintenance or removing from service. The drill pipe positioning arm 23 is also pivoted from the support frame 16 in such a manner that it may be rotated in a horizontal plane to a drill pipe pick-up point using cylinders 24. The positioning arm may then be rotated to a point which positions the drill pipe 66 directly over the centerline of the well being drilled. Additional cylinders 25 then elevate the drill pipe 66 to allow a screwed connection to be made to either: the threaded bottom end of the top drive shaft 30, the threaded bottom end of the elevator link adapter 27 (when it is used), or to the threaded end of the saver sub 67 when it is used. Since the motive force of the top drive is centered about the central shaft 30, the reactive forces are balanced and a concentric balanced force is imparted to the drill string.

The wrenching device 26, 31 is also pivotably connected on the support frame 16 in such a manner that it may be rotated aside in a horizontal plane to allow access for maintenance or removal.

Figure 2A:
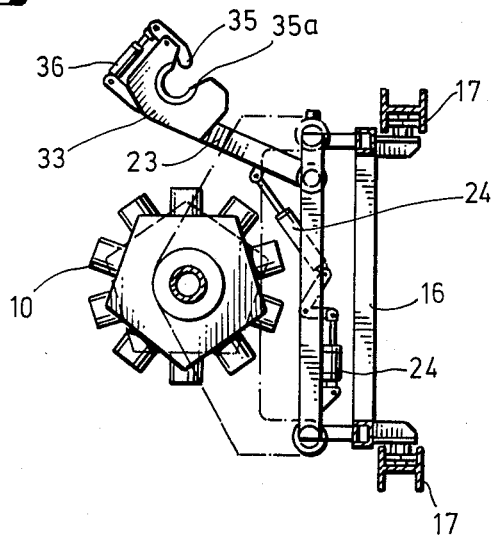
FIG. 2A is a top view of the device of FIG. 2B.
Figure 2B:
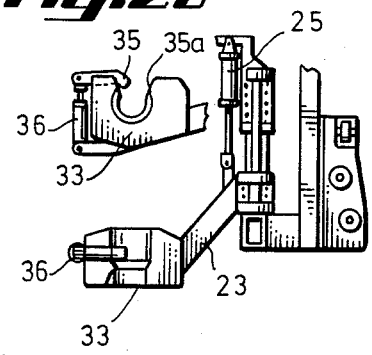
FIG. 2B is a side view of the pipe positioning and handling mechanism.

Referring now to FIG. 2, the positioning arm bowl 33 is designed with a "U" shaped opening with a tapered seat to match the drill pipe tool joint. The latch arm 35 moves to allow the entry of drill pipe. The latch arm is spring loaded to the closed position. Drill pipe may be loaded by pushing into the opening 35*a*. A cylinder 36 is used to move the latch to the open position. Cylinder 25 when actuated, moves the drill pipe into contact with the mating thread on the top drive shaft 30. The latch may also be activated manually.

Figure 3:
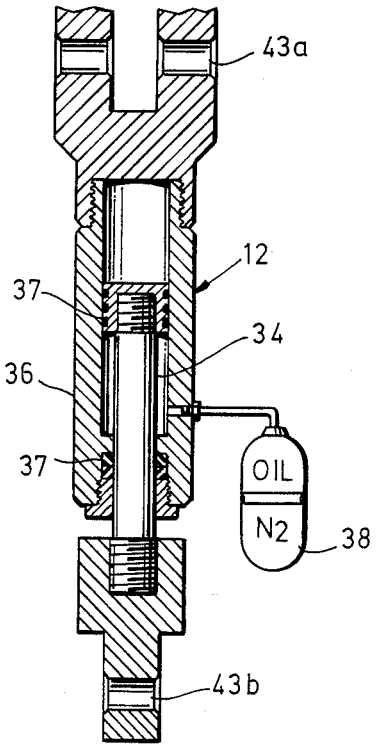
FIG. 3 is a sectional view of the bail link counterbalance.
Figure 4A:
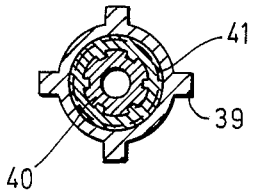
FIG. 4A is a view along line 4A—4A of FIG. 4.

Referring now to FIG. 3, the hydraulically cushioned bail link has a piston 34 which acts upward in the cylinder barrel 36 as a result of fluid under pressure entering the interior of the barrel 36. This internal force acts like a compression spring. When the rod 34 is actuated downward by a load the potential energy is stored within the chamber 38. As long as the load is more than the potential energy, the distance between the attaching holes 43*a* and 43*b* will be at maximum. When the load is next reduced such as when a section of drill stem is unscrewed, the distance between the attaching holes will decrease, the drill string proper will remain stationary in the hole, the drilling swivel 11 will move upward as the threaded members of the drill string separate, while the section being unscrewed is raised by the action of the piston 34 within the barrel 36 to an upward position. When the load is entirely removed, the distance between the centers of the attaching holes will be at minimum. Packing seals 37 maintain the pressure required to move the piston.

Figure 4:
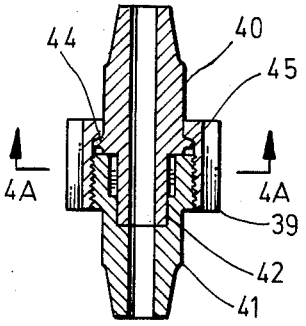
FIG. 4 is a sectional view of the splined quick disconnect.

Referring now to FIG. 4, a tubular member 40 containing a male spline and an extension bearing a sealing element 42 is inserted within a female spline contained in the threaded section 41. A threaded collar 39 is screwed to mate with the threads on the threaded member 41. An inside shoulder 45 on collar 39 shoulders against a projection 44 on member 40 and thereby locks the assembly as a splined and sealed unit. Torque is transmitted through the splines.

Referring now to FIG. 5, the wrenching device upper section 26 has the box section g securely attached to support members a. Die block c is attached to inner die carrier d. Blocks b and c are able to move inward or outward on guides h. Cylinder k when pressurized in chamber q moves block b into contact with tubular workpiece m. As block b engages workpiece m a reactionary force moves inner die carrier d in a direction away from workpiece m until die block c which is attached to die carrier d is forced to engage workpiece m. In operation, pressure in chamber q creates a gripping force which firmly engages serrated dies s against the workpiece m. In the reverse action, cylinder k is pressurized in chamber r causing die block b to move away from workpiece m. After partial travel, block b will contact stops e which will cause the body of cylinder k and the inner die carrier d to move inward toward the workpiece m. This action forces the die block c away from workpiece m.

Referring now to FIG. 7 which is a bottom view of the lower, rotatable section 31 of the wrenching device, the box section g is securely attached to circular guide plate f. Die block c is attached to inner die carrier d with pins p. Blocks b and c are able to move inwardly and outwardly, being aligned by guides h. Cylinder k when pressurized in chamber q moves block b to contact tubular workpiece m. As block b engages workpiece m, a reactionary force moves inner die carrier d in a direction away from the workpiece m until die block c engages workpiece m. In operation, pressure in chamber q creates a gripping force which firmly engages serrated dies s against workpiece m.

In the reverse action, the cylinder k is pressurized in chamber r causing die block b to move away from workpiece m. After partial travel, block b will contact stops e which causes the body of cylinder k to move toward the workpiece m. Since inner die carrier d is attached to cylinder k, die carrier d will move toward workpiece m and force block c away from the workpiece m, the force being transferred thru pins p which attach die block c to inner die carrier d. Torque arms t are securely attached to box section g.

Referring now to FIG. 8 which is a sectional view or the apparatus shown in FIG. 7, the circular guide plate f features a guide lip u which will be used in attaching the assembly of FIG. 7 to the upper section of the wrenching device shown in FIG. 5.

Referring now to FIG. 9, a typical section thru either the top wrenching section or the lower wrenching section is shown illustrating the method of attaching an inner die carrier d to a die block c using a pin p.

Referring now to FIG. 6, the cylinders v are affixed to the lower section z of the wrenching device through a clevis aa at the rod end. The barrel end is connected to the upper section BB through a hinged joint w and the reaction is restrained by the upper section BB. When the cylinders are energized, the lower section will rotate the centerline of the guided die blocks about axis y. The annular groove and tongue u and x align and secure the upper and lower halves together while allowing rotary motion. When the bolts B are removed the wrenching device is free to pivot in a horizontal plane about Point P as shown in FIG. 1.

With this invention, well drilling fluids enter the drill string through a conventional flexible hose connected to the swivel 11 shown in FIG. 1. The swivel has a hollow shaft through which fluids pass into the hollow shaft 30 of the top drive 10 and on through the hollow sections of the remaining subs or devices into the interior of the drill string.

The top drive apparatus according to the present invention compare very favorably with the prior art drive apparatuses. The following chart compares certain features (but not all) of a top drive according to the present invention to the top drive embodying features disclosed in U.S. Pat. No. 4,449,596 and to the Bowen ES-7 Electric Drilling Swivel:

| Prior Art | THE PRESENT INVENTION |
|---|---|
| Electrical power is conducted from the generating room to the unit through rubber covered electrical cables. Danger of damaging and sparking is ever present. An accident at a time when well head gasses are present could be disasterous. | Operated by hydraulic fluid. There is no danger of sparking. The hydraulic power unit is located in a safe area. |
| Complete drilling system weighs approximately 20 tons. | Complete system weighs 10 tons or less. |
| In the event of mechanical failure requires complete "rig down"; the replacement of the top drive assembly would be more complex. | Unit is designed to accommodate rapid replacement of the hydraulic Top Drive. Because of this feature several hours of down time are saved. |
| User confidence in the reliability of this unit is not high. Consequently, all installations are equipped with a conventional (rotary table) drive system on "standby". | Reliability of this system would allow users to eliminate the rotary table drive systems; spare hydraulic motors and components are the only "back-up" equipment. This saves hundreds of thousand dollars rig cost. |
| Hazardous area certificates are required for the numerous safety devices used to monitor systems designed to render this unit safe for use in a hazardous location. This is time consuming and expensive. | Electrical devices are located below the drill floor in a pressured safe room which already exists. The multitude of monitoring devices used on the electric drive are not required. |
| During drilling, excessive bit weight or hole friction stalls out the electric motor and stops the drill bit. Common practice is to reduce bit weight. Since full electrical potential remains applied, the drill suddenly accelerates from zero to up to 250 R.P.M. in a matter of seconds. This causes over-tightening of tool joint threads and ruins the drill pipe. Also the drill string may whip and damage the wall of the hole. Mechanical reaction is transmitted to the derrick through the support mechanisms and this vibration damages the structure and is very noisy. | Fluid power because of its inherent nature is much smoother. The mechanics of the moving fluid are such that acceleration after stall will be smoother and uniform. Less damage to drill hole and equipment are realized. |
| Air purging the inside of the electric drilling motor is required at initial start-up and at every time a safety device actuates. This may require 10 to 30 minutes. | No purging is required because there is no air cooling system. |
| On units so equipped there is a danger of water leaking into the electric motor following any damage or corrosive failure of the water to air heat exchanger used to cool the motor air. These systems are required wherever you find stringent safety measures such as North Sea Platforms. This can cause the motor to fail. | No such system is required. |
| Making drill pipe connection: The drill pipe is picked up by the elevator bowl and the lower end stabbed in the previous pipe. Human skill is then required to ease the drive shaft down into the thread to screw it up. Thread damage can occur. | The pipe handling device on this unit has a hydraulic lift to engage the thread. Proper adjustment will ensure minimal pressure on the threads. This is much quicker than when the driller has to execute skill and judgment making up each joint of pipe. |
| When picking up a length of drill pipe whose end is protruding about 3 ft. above the drill floor, the pipe handler must be tilted outward. Since the bowl of the pickup tool is swiveled, the angle is incorrect for the pipe. Also the latches on the pickup tool must be manually closed which takes time. | Perfect alignment and orientation of the pipe handling mechanism is achieved via mechanical stops and cylinders to create the necessary movement. The latch is spring loaded to automatically lock when the pipe is loaded. A cylinder will actuate the latch to the open position. This is by remote control which is much safer. This system is also much faster than the manual method. |
| Cost much more. | This system costs much less. This does not take into account the equipment which an operator does not have to buy, such as extra swivel and/or rotary table drive which would make the savings several hundred thousand dollars. |
| Installing this unit on land rigs or retrofitting to offshore rigs is very complicated because of size and different system. | Retrofit to any existing drilling rig can be accomplished much easier because of size and weight as well as simplicity of design. |
| The closed circuit air cooling system collects carbon dust which erodes from the bushes. This can lead to internal shorting. | No brushes are used. |
| Repeated stalling of the main electric motor especially for more than a few moments, under high current will damage the | No such stalling problem. |

-continued

| Prior Art | THE PRESENT INVENTION |
|---|---|
| armature and subsequent rotation will lead to failure. | |

Also, the top drive apparatus of the present invention compares favorably to a top drive embodying certain features of the device disclosed in the prior art U.S. Pat. No. 4,449,596 in the following respects:

| Prior Art | The Present Invention |
|---|---|
| Requires two circulating swivels because one is integral with power sub and one must be used when unit is rigged down. | Only one swivel is required. Current list price for a 500 ton swivel (Continental Emsco): $43,290.00 |
| Requires explosion proof cooling air system. Present design uses blower mounted on support dolly or drill floor and air is conducted through 8" flexible rubber duct. This lightweight duct is often windblown and damaged from hanging on the rig structure. Hot air is exhausted to atmosphere creating a hazardous condition. Documentation for the alternating current fan motor and approval for the D.C. drive motor is time consuming and expensive. | Hydraulic oil is cooled by rig supplied water being circulated through an oil cooler. This equipment is located in an existing safe location. |
| The overall height, width and depth is much greater; requires approximately 46 ft. of vertical derrick height. | This unit requires less than 36 ft. |
| The unit does not have a "rise and fall" mechanism to minimize load on drill stem threads when unscrewing. | Counterbalance mechanism is provided. |
| Unit must swung back in order to install well casing. | All normal drilling and casing installation is done with standard unit. |

While certain specific embodiments of the present invention have been disclosed, the invention is not limited to these particular forms, but is applicable to all variations which fall within the scope of the following claims

We claim:

1. An apparatus for use on a well derrick for handling and rotating pipe of a string of pipe, part of the string extending into a wellbore, the string, wellbore, and derrick each having a vertical axis, the apparatus comprising:

a hydraulic top drive having a single central hollow drive shaft for imparting a concentric and balanced force to a pipe to which it is connected, the shaft connectable either to mating intermediaries or connectable directly to the pipe so that the vertical axis of the drive shaft is alignable coaxially with the vertical axis of the pipe, the shaft rotatable to rotate the pipe, the shaft hollow along its length for receiving well fluids and conducting the fluids into the pipe, a frame movably connected to the derrick for movement up and down on the derrick, the top drive connected to the frame for movement therewith up and down on the derrick and for pivoting with respect to the frame, pivot means for pivotably mounting the top drive to the frame for pivoting the top drive levelly in a horizontal plane to, toward and away from the vertical axis of the string of pipe and the vertical axis of the derrick so that the vertical axis of the hollow drive shaft is alignable coaxially with the vertical axis of the string of pipe and so that the vertical axis of the hollow drive shaft is alignable coaxially with the vertical axis of the wellbore and of the derrick, and a pipe lifting and positioning arm pivotably connected to the frame independently of the top drive for lifting pipe into position and for levelly pivoting on the frame in a horizontal plane toward and away from the vertical axis of the derrick, the arm pivotable independently of the top drive.

2. An apparatus for use on a well derrick for handling and rotating pipe of a string of pipe, part of the string extending into a wellbore, the string, wellbore, and derrick each having a vertical axis, the apparatus comprising:

a hydraulic top drive having a single central hollow drive shaft for imparting a concentric and balanced force to a pipe to which it is connected, the shaft connectable either to mating intermediaries or connectable directly to the pipe so that the vertical axis of the drive shaft is alignable coaxially with the vertical axis of the pipe, the shaft rotatable to rotate the pipe, the shaft hollow along its length for receiving well fluids and conducting the fluids into the pipe, a frame movably connected to the derrick for movement up and down on the derrick, the top drive connected to the frame for movement therewith up and down on the derrick and for pivoting with respect to the frame, pivot means for pivotably mounting the top drive to the frame for pivoting the top drive levelly in a horizontal plane to, toward and away from the vertical axis of the string of pipe and the vertical axis of the derrick so that the vertical axis of the hollow drive shaft is alignable coaxially with the vertical axis of the string of pipe and so that the vertical axis of the hollow drive shaft is alignable coaxially with the vertical axis of the wellbore and of the derrick, and pipe wrenching means mounted on the frame for making up and breaking out connections of the top drive shaft and the string, the pipe wrenching means connected to the frame independently of the top drive and pivotably mounted to the frame for pivoting levelly in a horizontal plane toward and away from the vertical axis of the derrick, the pipe wrenching means pivotable independently of the top drive.

3. In combination with a well derrick an apparatus for rotating a continuous string of pipe part of which extends into a wellbore and whose vertical axis is substantially coincident with the vertical axis of the derrick and of the string, the apparatus comprising:

a hydraulically powered top drive having a single central hollow drive shaft, the drive shaft having threads for mating either with a threaded intermediary which is threadedly connectable to the pipe of the string of pipe or for mating directly with the pipe of the pipe string for supporting and rotating the string and for conducting well fluids through the shaft into the string of pipe, the drive shaft connectable so that the vertical axis of the shaft is alignable coaxially with the vertical axis of the pipe, a frame movably connected to the derrick for movement up and down within the derrick, pivot means for pivotably mounting the top drive to the frame means for levelly pivoting the top drive in a horizontal plane toward and away from the vertical axis of the string and the vertical axis of the derrick, so that the vertical axis of the hollow drive shaft is alignable coaxially with the vertical axis of the string and of the derrick, a pipe lifting and positioning arm pivotably connected to the frame independently of the top drive for lifting pipe into position and for levelly pivoting on the frame in a horizontal plane toward and away from the vertical axis of the string, the arm pivotable independently of the top drive, pipe wrenching means mounted on the frame for making up and breaking out connections of the top drive shaft and the string, the pipe wrenching means connected to the frame independently of the top drive, and the pipe wrenching means pivotably mounted to the frame for levelly pivoting in a horizontal plane away from the vertical axis of the string and away from the vertical axis of the derrick, the pipe wrenching means pivotable independently of the top drive.

* * * * *